US006830087B2

(12) United States Patent
Kumpulainen

(10) Patent No.: US 6,830,087 B2
(45) Date of Patent: Dec. 14, 2004

(54) METHOD AND EQUIPMENT FOR PRODUCING UNIFORMLY MOIST VENEER

(75) Inventor: Markku Kumpulainen, Lahti (FI)

(73) Assignee: Raute Oyj (FI)

( * ) Notice: Subject to any disclaimer, the term of this patent is extended or adjusted under 35 U.S.C. 154(b) by 0 days.

(21) Appl. No.: 10/212,214

(22) Filed: Aug. 6, 2002

(65) Prior Publication Data

US 2003/0029517 A1 Feb. 13, 2003

(30) Foreign Application Priority Data

Aug. 10, 2001 (FI) ..... 20011628

(51) Int. Cl.[7] ..... B27N 1/00
(52) U.S. Cl. ..... 144/332; 144/380; 144/394
(58) Field of Search ..... 144/330, 332, 144/380, 382, 392, 394, 2.1, 3.1; 156/39, 41

(56) References Cited

U.S. PATENT DOCUMENTS 3,950,574 A 4/1976 Butler
4,356,641 A * 11/1982 Rosenau ..... 34/537
4,831,747 A 5/1989 Roos et al.
4,945,652 A 8/1990 Clarke et al.
5,049,216 A 9/1991 Shead et al.
5,270,546 A * 12/1993 Jamroz et al. ..... 250/341.8
5,347,468 A * 9/1994 Rupp et al. ..... 700/284
5,524,771 A * 6/1996 Kairi et al. ..... 209/518

FOREIGN PATENT DOCUMENTS

FI 57892 7/1980

* cited by examiner

*Primary Examiner*—Allen Ostrager
*Assistant Examiner*—Shelley Self
(74) *Attorney, Agent, or Firm*—Connolly, Bove, Lodge & Hutz LLP

(57) ABSTRACT

The invention concerns a method to produce a uniformly moist veneer (6) or plywood. According to the invention moisture of the veneer (6) or plywood is measured in one or several points, and any moisture differences noticed in this veneer or plywood are levelled in a moistening stage following said measuring, in which stage the veneer or plywood, based upon measuring results received, is moistened with water or steam in one or several points in order to achieve an adjusted uniform moisture content.

20 Claims, 1 Drawing Sheet

METHOD AND EQUIPMENT FOR PRODUCING UNIFORMLY MOIST VENEER

Figure 1:
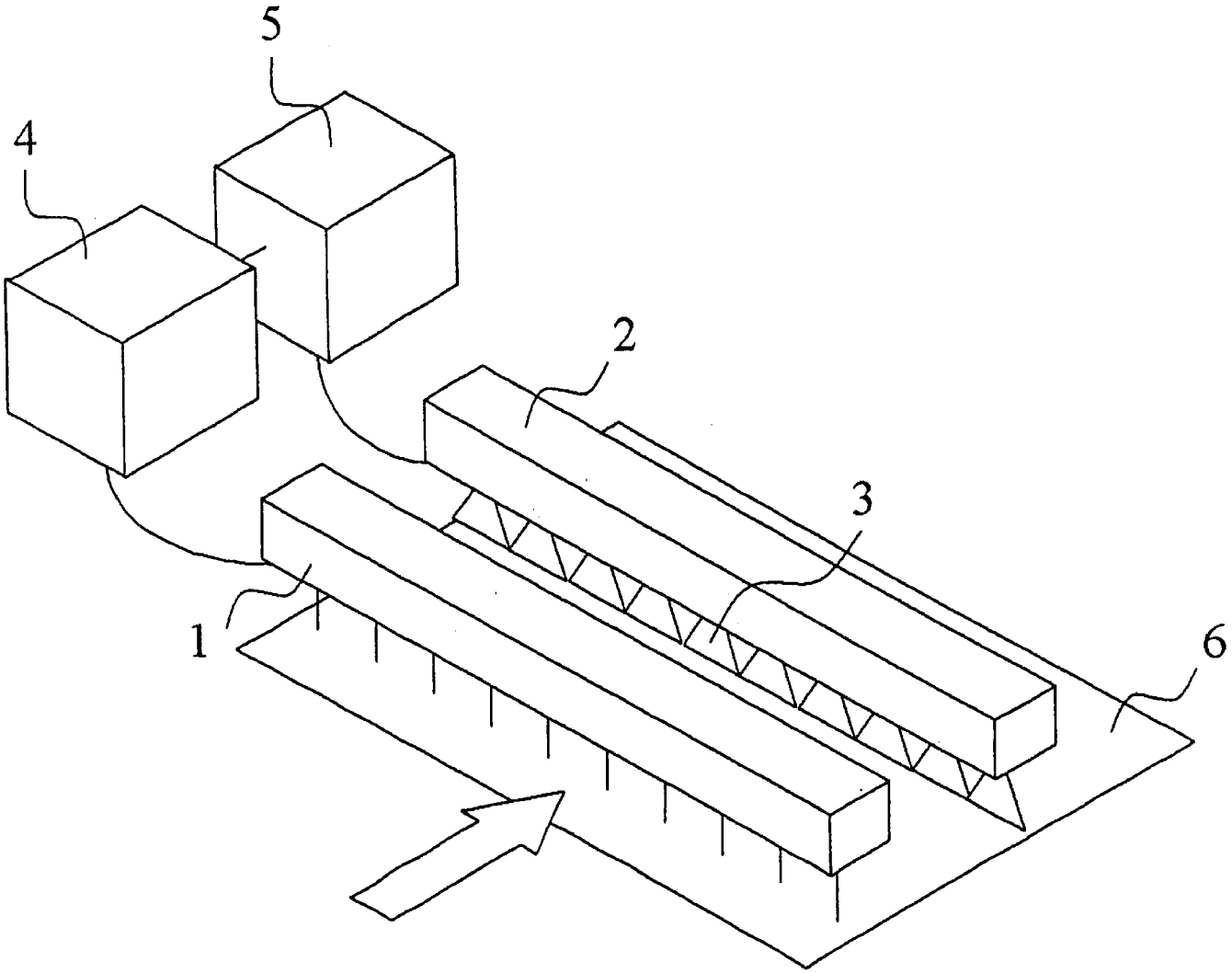

This invention refers to a method and an equipment for producing a uniformly moist veneer or plywood.

In manufacturing veneer the intention is to achieve a uniformly moist veneer after dryer. This will succeed only, if the veneer is dried to complete dryness, i.e. to a moisture content of 0%. A drawback of a completely dry veneer is that it is brittle and breaks easily. In order to avoid this, the veneer is usually dried on an average to a moisture content of about 5%. Hereby the moisture content of individual veneers will vary in the range of 0 to 15%.

A moisture meter for veneer is a generally known device. In some special cases it is also known to use moistening of veneer, but then the whole veneer is moistened, and any local moisture differences are not taken into consideration. Also moistening of plywood is known.

The object of the present invention is to produce a uniformly moist veneer or plywood, which can be achieved according to the invention in such a way that the moisture of the veneer or plywood is measured in one or several points, and any moisture differences noticed in this veneer or plywood are levelled in a moistening stage following said measuring, in which stage the veneer or plywood, based upon measuring results received, is moistened with water or steam in one or several points in order to achieve an adjusted uniform moisture content. This can be carried out by bringing to each point such an amount of water or steam, which is based upon the measuring result of said point, or alternatively the average moisture content of said veneer or plywood is calculated based upon the measuring results of said veneer or plywood, and based upon said average value the veneer or plywood is moistened to an adjustable level.

Moistening of the veneer or plywood can be carried out for instance by spraying water and/or steam on surface or surfaces of the veneer or plywood. Another way of moistening is to eject or spread water at one or both surfaces of the veneer or plywood.

Moisture measuring can be carried out either only at one side of the veneer or alternatively at both sides, whereby a still more exact information of local moisture variations of the veneer. Based upon the measuring results the moistening can in the same way be carried out either only at one side of the veneer or at both sides, regardless the moisture measuring was carried out only at one side or at both sides. Moistening both sides will guarantee a more uniform penetration of water into the veneer.

Moisture measuring and moistening can be arranged anywhere at the veneer manufacturing line after the dryer or possibly already before the dryer.

The equipment according to the invention comprises:

- a moisture meter arranged to measure moisture of a veneer or a plywood at one or more points;
- a moistening device comprising a plurality of independently adjustable moistening dies positioned down streams the moisture meter and extending across direction of motion of the veneer or plywood;
- moisture measuring electronics connected to the moisture meter, and
- a control system arranged to regulate the separate moistening dies of the moistening device based on impulses from the moisture measuring electronics.

The moisture meter may extend either along the grain of the veneer or across the grain. The moistening device has preferably as much moistening dies as the number of measuring points in the moisture meter, so that each moistening die is controlled by measuring results received from a measuring point of the moisture meter, which measured that part of the veneer or plywood, which comes into the area of influence of said moistening die.

The equipment may independently have moisture measuring points and/or moistening dies either only for one side or for both sides of the veneer.

Below the invention will be described in more detail with reference to the enclosed drawing showing a perspective view of an example of an equipment of the invention.

The equipment of the invention may be arranged at a suitable position of the veneer manufacturing line after the dryer or possibly already before the dryer.

In the disclosed embodiment the equipment comprises a moisture meter 1 extending across the direction of motion of the veneer 6 or plywood, said moisture meter having a plurality of adjacent, preferably uniformly distributed measuring points, so that moisture of the veneer 6 at different points over its whole width will be measured. Downstream from the moisture meter 1 there is a moistening device 2 extending across the path of movement of the veneer 6, said device having a plurality of independently adjustable moistening dies 3 uniformly distributed across the width of the veneer 6 or the plywood. The moisture meter 1 is connected to moisture measuring electronics 4, which based on measuring results is arranged to send impulses to a control system 5, which based on quality of veneer or plywood to be treated and on received impulses is programmed to regulate the separate moistening dies of the moistening device in order to receive a uniform final moisture.

What is claimed is:

1. A method for producing a uniformly moist veneer or plywood, comprising:

measuring the moisture of the veneer or plywood at one or more points;

dentifying any moisture differences existing in the veneer or plywood; and leveling any moisture differences identified in the veneer or plywood by moistening the veneer or plywood with water or steam at one or more moistening points based upon results obtained from measuring the moisture of the veneer or plywood.

2. Method according to claim 1, wherein measuring the moisture of the veneer or plywood is carried out at two sides of the veneer or plywood.

3. Method according to claim 1, wherein moistening of the veneer or plywood is carried out at two sides of the veneer or the plywood.

4. Method according to claim 1, wherein each moistening point among said one or more moistening points is moistened with an amount of water or steam based on results obtained from measuring the moisture of each moistening point.

5. Method according to claim 1, wherein moistening of the veneer or plywood is based on an average moisture content calculated from results obtained from measuring the moisture of the veneer or plywood.

6. Method according to claim 1, wherein measuring the moisture of the veneer or plywood and moistening of the veneer or plywood are carried out at a manufacturing line anywhere after a dryer.

7. Method according to claim 1, wherein measuring the moisture of the veneer or plywood and moistening of the veneer or plywood are carried out before a dryer.

8. Method according to claim 1, wherein moistening of the veneer or plywood is carried out by spraying water and/or steam.

9. Method according to claim 1, wherein moistening of the veneer or plywood is carried out by ejecting or spreading water at the surface of the veneer.

10. Equipment for producing a uniformly moist veneer or plywood, comprising:

a moisture meter arranged to measure moisture of a veneer or a plywood at one or more measuring points;

a moistening device comprising a plurality of independently adjustable moistening dies positioned downstream from the moisture meter and extending across a direction of motion of the veneer or plywood;

moisture measuring electronics connected to the moisture meter; and a control system ranged to regulate the moistening dies based on impulses from the moisture measuring electronics.

11. Equipment according to claim 10, wherein the moisture meter extends across the direction of motion of the veneer or plywood.

12. Equipment according to claim 11, wherein the moistening device comprises a number of said moistening dies corresponding to the a number of measuring points of the moisture meter.

13. Equipment according to claim 10, comprising a moisture meter and/or a moistening device at both two sides of the veneer or plywood.

14. Method according to claim 2, wherein moistening of the veneer or plywood is cried out at both two sides of the veneer or the plywood.

15. Method according to claim 2, wherein each moistening point among said one or more moistening points is moistened with an amount of water or steam based on results obtained from measuring the moisture of each moistening point.

16. Method according to claim 3, wherein each moistening point among said one or more moistening points is moistened with an amount of water or steam based on results obtained from measuring the moisture of each moistening point.

17. Method according to claim 2, wherein moistening of the veneer or plywood is based on an average moisture content calculated from results obtained from measuring the moisture of the veneer or plywood.

18. Method according to claim 3, wherein moistening of the veneer or plywood is based on an average moisture content calculated from results obtained from measuring the moisture of the veneer or plywood.

19. Method according to claim 2, wherein measuring the moisture of the veneer or plywood and moistening of the veneer or plywood are carried out at a manufacturing line anywhere after a dryer.

20. Method according to claim 3, wherein measuring the moisture of the veneer or plywood and moistening of the veneer or plywood is are carried out at a manufacturing line anywhere after a dryer.

* * * * *